US007841312B2

(12) United States Patent
Richter

(10) Patent No.: US 7,841,312 B2
(45) Date of Patent: Nov. 30, 2010

(54) ADJUSTMENT DEVICE FOR A CAMSHAFT

(75) Inventor: Frank Richter, Oberteuringen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 296 days.

(21) Appl. No.: 12/282,380

(22) PCT Filed: Feb. 12, 2007

(86) PCT No.: PCT/EP2007/051306

§ 371 (c)(1),
(2), (4) Date: Sep. 25, 2008

(87) PCT Pub. No.: WO2007/104620

PCT Pub. Date: Sep. 20, 2007

(65) Prior Publication Data

US 2009/0095124 A1 Apr. 16, 2009

(30) Foreign Application Priority Data

Mar. 15, 2006 (DE) ..... 10 2006 011 806

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 6,328,008 | B1 | 12/2001 | Io | |
| 6,805,081 | B2 * | 10/2004 | Watanabe et al. | 123/90.17 |
| 2003/0131812 | A1 | 7/2003 | Hosoya | |
| 2006/0236967 | A1 | 10/2006 | Gregor et al. | |

FOREIGN PATENT DOCUMENTS

| | | | |
|---|---|---|---|
| DE | 100 37 942 | A1 | 3/2001 |
| DE | 103 55 560 | A1 | 8/2005 |
| JP | 02-011809 | | 1/1990 |
| WO | WO-2005/061861 | A1 | 7/2005 |

* cited by examiner

*Primary Examiner*—Zelalem Eshete
(74) *Attorney, Agent, or Firm*—Davis & Bujold, P.L.L.C.

(57) ABSTRACT

An adjustment device for a camshaft includes a brake system and a superposition gear system connected on a drive output side to the camshaft and on the drive input side to the crankshaft, such that to adjust the camshaft the superposition gear system dissipates part of the energy from the drive side into the brake system. The brake system is a frictional brake system, such that the necessary braking force is produced by a friction lining that operates in a slipping condition.

5 Claims, 1 Drawing Sheet

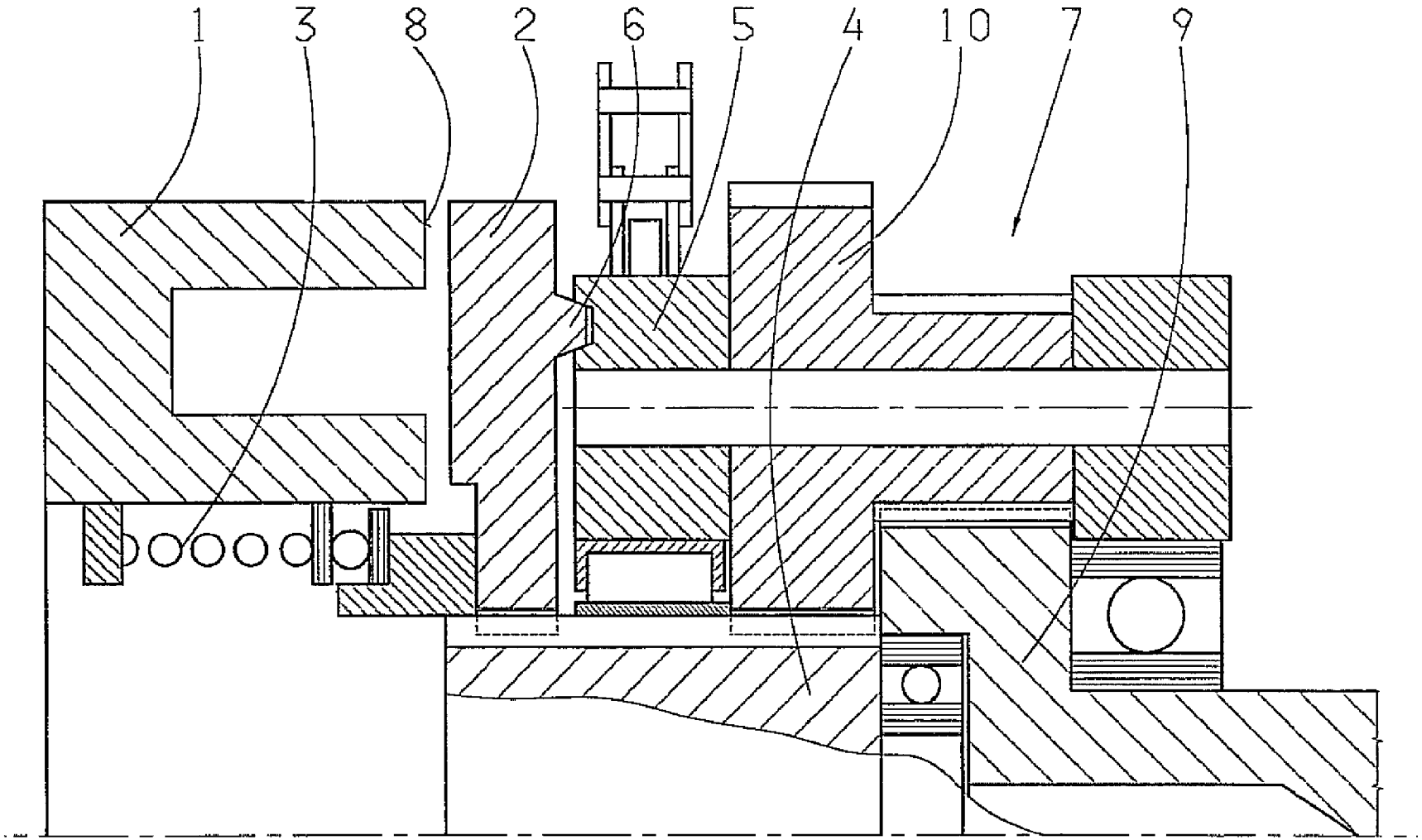
9
7
10
4
5
6
2
8
3
1

ADJUSTMENT DEVICE FOR A CAMSHAFT

This application is a national stage completion of PCT/EP2007/051306 filed Feb. 12, 2007, which claims priority from German Application Serial No. 10 2006 011 806.5 filed Mar. 15, 2006.

FIELD OF THE INVENTION

The present invention concerns an adjustment device for a camshaft.

BACKGROUND OF THE INVENTION

From the prior art, it is known to produce the adjustment movement of the camshaft by way of wear-free and no-contact brake systems.

An adjustment device for a camshaft of an internal combustion engine is known from DE 103 55 560 A1, which comprises a drive input element driven by a crankshaft of the engine, a drive output element that drives the camshaft of the engine and a control element, which is acted upon by a brake, such that a relative rotation between the drive input element and the drive output element can be produced by varying the braking torque on the control element. In this, the structural form of the adjustment device allows any desired phase angle between the said drive input and drive output elements. The brake is made as an electromagnetic brake that works without contact. Preferably a hysteresis brake is used, whose braking torque is independent of speed.

Owing to the necessary components that work without contact, such systems are disadvantageously expensive and they also require fail-safe, locking means for which an additional actuator is needed.

Thus, the purpose of the present invention is to indicate an adjustment device for a camshaft, which can be produced inexpensively.

SUMMARY OF THE INVENTION

An adjustment device for a camshaft is proposed, which comprises a brake system and a superposition gear system connected to the camshaft on its drive output side and to the crankshaft on its drive input side such that, to adjust the camshaft, the superposition gear system dissipates part of the energy from the drive input side into the brake system and the brake system is made as a frictional brake system with which the necessary braking force is produced by a friction lining operated permanently in a slipping condition. Furthermore, the adjustment device comprises additional, mechanical locking means.

By way of the frictional brake system according to the invention, a phase adjustment between a chain wheel or belt pulley on the drive input side and the camshaft on the drive output side can be carried out, or a phase position, once set, can be maintained.

In a particularly advantageous embodiment of the invention, the frictional brake system is made as an electromagnetically actuated frictional system. Moreover, the superposition gear system can consist of a planetary transmission or a transmission with two solar spur gears and a two-stage planetary gear and, indeed, any form of superposition gearing is also suitable for use in the system.

By virtue of the design concept costs are reduced, since no expensive, non-contact systems are needed and the fail-safe locking means necessary in the system can be co-actuated conjointly with the shift movement of the friction lining. In this way, an entire actuator can advantageously be saved.

BRIEF DESCRIPTION OF THE DRAWING

The invention will now be described, by way of example, with reference to the accompanying drawing in which:

The sole FIGURE shows a schematic sectional view thereof.

DETAILED DESCRIPTION OF THE INVENTION

A frictional brake system with additional mechanical locking of an adjustment device, according to the invention, comprises an electrically actuated shift solenoid 1, which has a friction surface 8, a magnetic friction lining 2 with a locking element 6 and a spring 3, such that the locking element 6 co-operates with an element 5 of a superposition gear system 7 on the drive input side. The friction lining 2 is attached axially, movably, but rotationally fixed on a spur gear 4 of the superposition gear system 7.

In the embodiment illustrated, the superposition gear system 7 is made as a transmission with two solar spur gears 4, 9 and a two-stage planetary gear 10. The camshaft is connected rotationally fixed to the second spur gear 9 of the superposition gear system 7. The drive input is connected to the planetary gear carrier.

When the superposition gear system 7 is made as a planetary transmission it is advantageous to arrange the friction lining 2 on the teeth of the sun gear. In such a case, the camshaft is connected to the ring gear.

When the shift solenoid 1 is not energized, there is no electromagnetic force on the friction lining 2 so that, due to the force of the spring 3 on the friction lining 2, the spur gear 4 is positively engaged with the drive-side element 5 of the superposition gear system 7 via the friction lining 2 and the locking element 6.

When the shift solenoid 1 is energized, the magnetic force acts on the friction lining 2 so that the friction surface of the friction lining 2 makes contact with the friction surface 8 of the shift solenoid 1. At the same time, the locking element 6 is disengaged from the drive-side element 5 of the superposition gear system 7. The braking torque built up by way of the shift solenoid 1 can now be transmitted via the spur gear 4 to the superposition gearing 7.

By electrical regulation of the shift solenoid 1, the necessary phase position can be set and maintained by way of a planetary gearset or some other form of superposition gear system. To be able to operate the friction lining in a condition of pronounced slip, it can be provided that the friction lining 2 is permeated by oil. This can take place either from the outside (oil spray, etc.) or via the middle of the camshaft.

The friction lining 2 can be made as a paper lining with a special texture, for example comprising radial grooves with a honeycomb pattern or as a carbon lining. In the case of a carbon lining, its thickness can be around 0.05 mm. A carbon lining has the advantage that very little wear takes place.

According to an advantageous further development of the invention, the braking torque can be provided by a hydrodynamic slide bearing surface. The braking torque is generated by shear forces in the oil film of the friction lining 2. In this case, the friction surface remains free from wear. According to the invention, the braking torque can also be produced by mixed friction.

REFERENCE NUMERALS

1 shift solenoid
2 friction lining
3 spring
4 spur gear
5 drive-side element of the superposition gear system 7
6 locking element
7 superposition gear system
8 friction surface of the shift solenoid 1
9 spur gear
10 planetary gear

The invention claimed is:

1. An adjustment device for a camshaft, the adjustment device comprising a brake system and a superposition gear system which is connected on a drive output side to the camshaft and on a drive input side to a crankshaft, such that to adjust the camshaft, the superposition gear system dissipates a portion of energy from the drive input side into the brake system, the brake system being a frictional brake system in which a necessary braking force is produced by a friction lining (2) that operates permanently in a slipping condition and the brake system being an electromagnetically actuated frictional system, the brake system comprises an electrically actuated shift solenoid (1) having a friction surface (8), a friction lining (2) with a locking element (6) that co-operates with a drive-side element (5) of the superposition gear system (7), and a spring (3), the friction lining (2) being axially slidable and rotationally fixed on a spur gear (4) of the superposition gear system (7), such that when the shift solenoid (1) is not energized, the force of the spring (3) and via the friction lining (2) and the locking element (6), the spur gear (4) is positively engaged with the drive-side element (5) of the superposition gear system (7), and when the shift solenoid (1) is energized, a magnetic force on the friction lining (2), causes the spur gear (4) to contact with the friction surface (8) of the shift solenoid (1) such that a braking torque built up by the shift solenoid (1) is transmitted, via the spur gear (4), to the superposition gear system (7).

2. The adjustment device for a camshaft according to claim 1, wherein the friction lining (2) of the brake system is permeated by oil which radially flows from one of a radial exterior of the friction lining and an interior of the camshaft.

3. The adjustment device for a camshaft according to claim 2, wherein the friction lining (2) is one of a paper lining with a special embossed pattern and a carbon lining.

4. The adjustment device for a camshaft according to claim 1, wherein the braking torque is produced by a hydrodynamic slide bearing surface and is generated by shear forces in the oil of the friction lining (2).

5. The adjustment device for a camshaft according to claim 1, wherein the superposition gear system (7) is one of a planetary transmission and a gear system having two solar spur gears and a two-stage planetary gear.

* * * * *